US005433517A

United States Patent [19]

Fleisch

[11] Patent Number: 5,433,517

[45] Date of Patent: Jul. 18, 1995

[54] PULLOUT ASSEMBLY FOR DRAWERS

[75] Inventor: Walter Fleisch, Lustenau, Austria

[73] Assignee: Alfit Aktiengesellschaft, Götzis, Austria

[21] Appl. No.: 92,744

[22] Filed: Jul. 14, 1993

[30] Foreign Application Priority Data

Jul. 15, 1992 [AT] Austria ..... 1444/92

[51] Int. Cl.[6] ..... A47B 88/00

[52] U.S. Cl. ..... 312/334.8; 312/334.46

[58] Field of Search ..... 312/333, 334.8, 334.46, 312/334.11, 334.12

[56] References Cited

U.S. PATENT DOCUMENTS 5,033,805 7/1991 Hobbs .
5,169,328 12/1992 Schenk .

FOREIGN PATENT DOCUMENTS 1814714 7/1970 Germany .
2721231 11/1978 Germany .
8801144 2/1988 WIPO .

*Primary Examiner*—Jose V. Chen

*Assistant Examiner*—Gerald A. Anderson

*Attorney, Agent, or Firm*—Collard & Roe

[57] ABSTRACT

A sequentially operable drawer slide arrangement comprises a stationary cabinet slide rail, an intermediate slide rail guided on the cabinet slide rail by a roller mounted on the cabinet slide rail for sliding movement with respect to the cabinet slide rail between a retracted and an extended position, a drawer slide rail guided on the intermediate slide rail by a roller mounted on the intermediate slide rail for sliding movement with respect to the intermediate slide rail between a retracted and an extended position, and a mechanism for sequencing the sliding movements of the intermediate and drawer slide rails between said positions. This mechanism comprises a coupling element arranged on the intermediate slide rail close to a forward end thereof for pivoting between two end positions to lock the intermediate slide rail selectively to the cabinet slide rail or the drawer slide rail in the respective end positions, and abutment devices respectively arranged on the cabinet and drawer slide rails to cooperate with the coupling element.

11 Claims, 3 Drawing Sheets

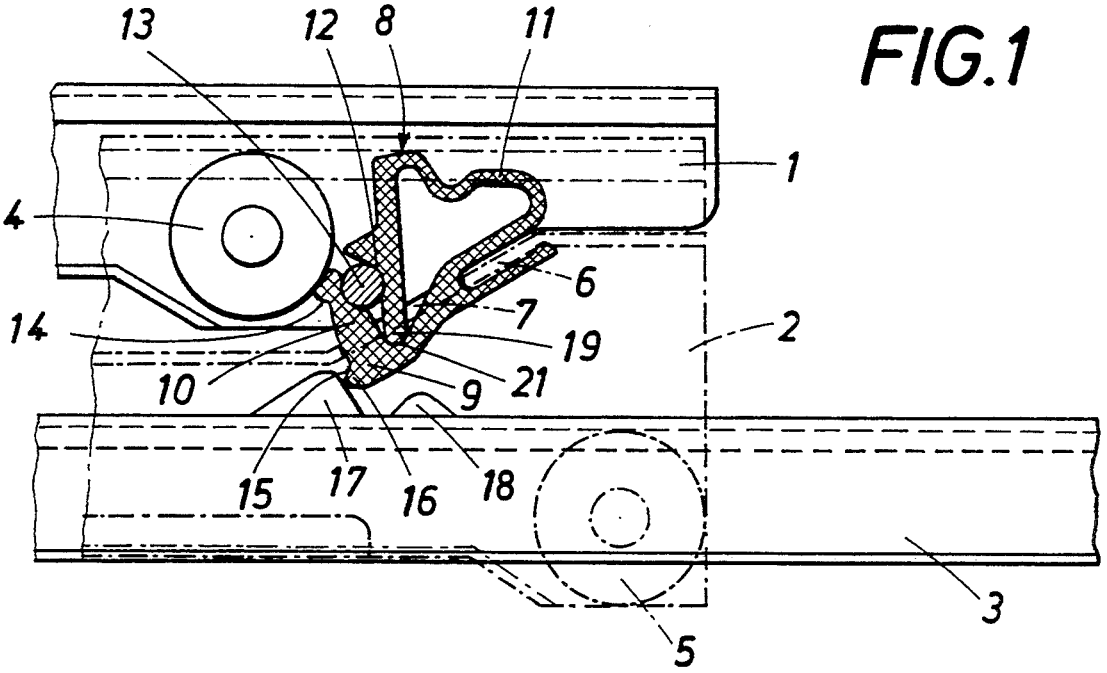
FIG.1
FIG.2
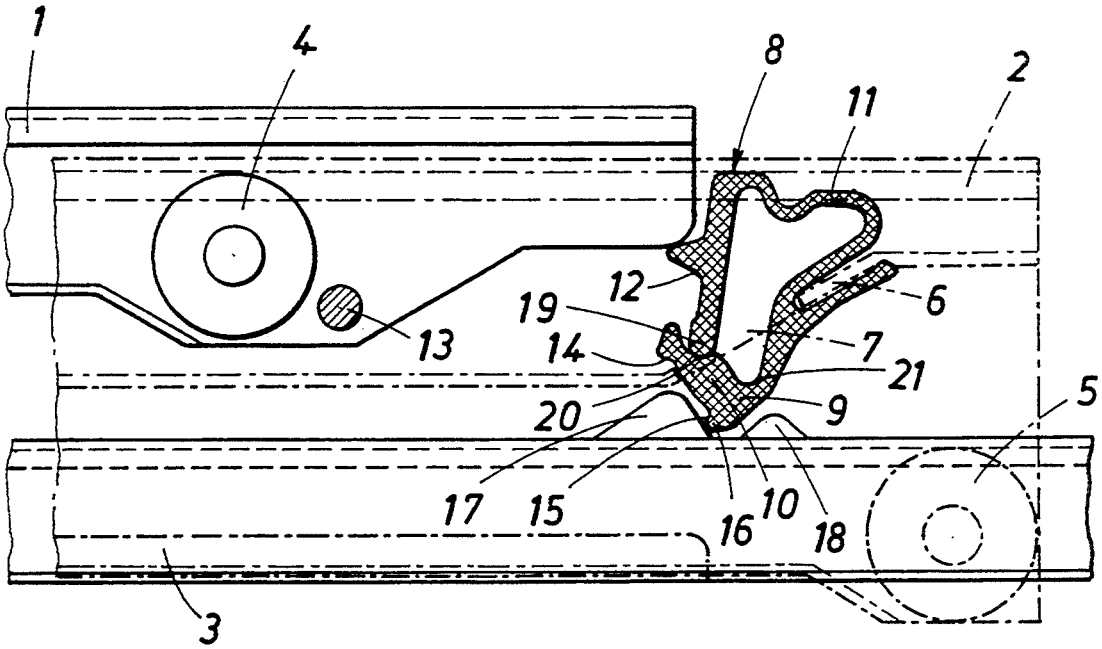

FIG. 5
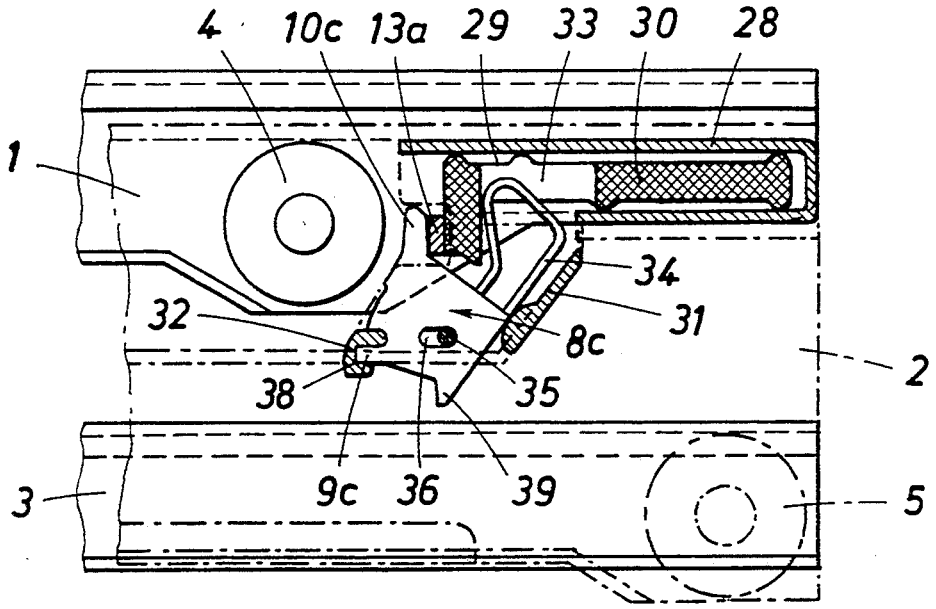
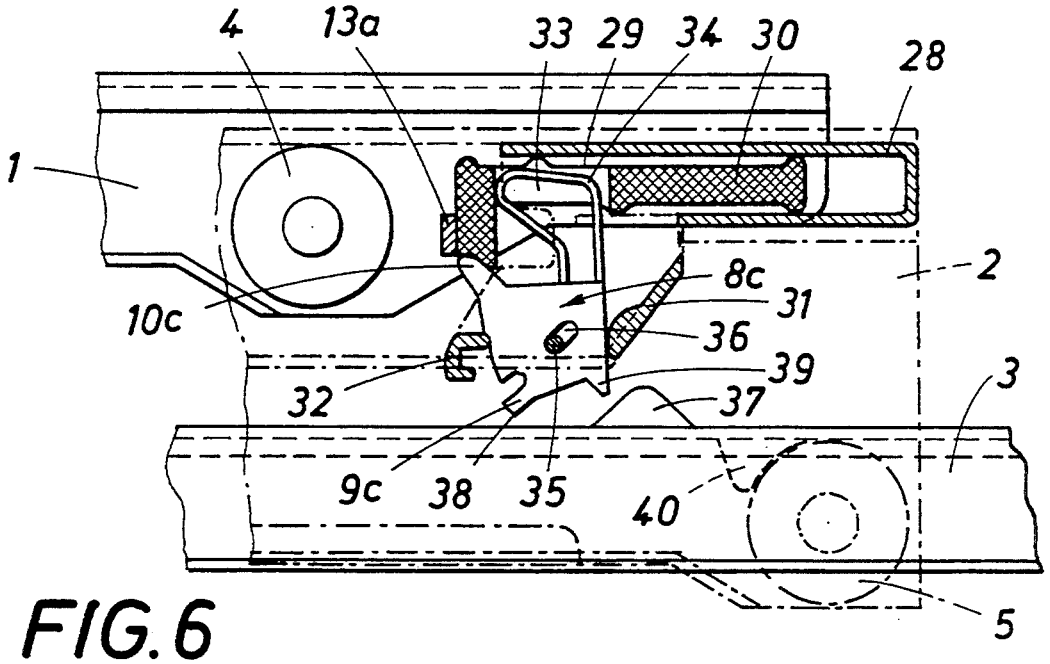
FIG. 6

PULLOUT ASSEMBLY FOR DRAWERS

The present invention relates to a sequentially operable drawer slide arrangement comprising a stationary cabinet slide rail, an intermediate slide rail guided on the cabinet slide rail by a roller mounted on the cabinet slide rail for sliding movement with respect to the cabinet slide rail between a retracted and an extended position, a drawer slide rail guided on the intermediate slide rail by a roller mounted on the intermediate slide rail for sliding movement with respect to the intermediate slide rail between a retracted and an extended position, and means for sequencing the sliding movements of the intermediate and drawer slide rails between the retracted and extended positions.

In known means for sequencing the sliding movements of the intermediate and drawer slide rails so that the drawer slide rail may be fully extended, the sliding action depended more or less accidentally on which one of the slide rails presented a lower resistance to the extending movement. In most cases, the drawer rail and the intermediate rail are moved simultaneously relative to the intermediate rail and the cabinet rail, respectively, before respective stops limit their movements. The sequence of sliding actions on their return movement is also not clearly defined. If the intermediate slide rail was moved along with the drawer slide rail during a short extension of the drawer rail, the intermediate rail frequently had to be moved back past the almost completely retracted drawer rail when the drawer was closed. This may result in undesirable noise when the cooperating stops strike against each other. Furthermore, it is usually undesirable for the intermediate slide rail to be moved along when the drawer is only slightly extended and then becomes visible in a position which is undefined in relation to the drawer. Pullout arrangements in which the slide rails are permanently coupled to each other by gears or friction couplings are very expensive structures with special rails, and they are subject to frequent malfunction.

It is an object of this invention to provide a pullout assembly of the first-described type, which uses simple means for clearly defining the sequencing of the sliding movements of the slide rails relative to each other during the extension and retraction of the drawer, which automates the sliding movements and, in particular, moves only the drawer slide rail with the drawer or places the intermediate slide rail in a definite relative position to the drawer slide rail when the drawer is extended only a little.

This object is accomplished with a sequentially operable drawer slide arrangement of the first-described structure, in which the means for sequencing the sliding movements comprises a coupling element arranged on the intermediate slide rail close to a forward end thereof for pivoting between two end positions to lock the intermediate slide rail selectively to the cabinet slide rail or the drawer slide rail in the respective end positions, and abutment devices respectively arranged on the cabinet and drawer slide rails to cooperate with the coupling element. The abutment device on the cabinet slide rail cooperates with the coupling element in one end position to lock the intermediate slide rail positively to the cabinet slide rail in a predetermined retracted position while, upon moving the slide rails into a predetermined extended position, the abutment device on the drawer slide rail simultaneously releases the coupling element from the one end position and pivots it into the other end position wherein it cooperates with the abutment device on the drawer slide rail to lock the intermediate slide rail to the drawer slide rail, the coupling element being restored to the one end position positively locking the intermediate slide rail to the cabinet slide rail upon moving the slide rails into the predetermined retracted position.

The use of a positively locking coupling element prevents undesired noise. For pulling out the drawer, the intermediate slide rail may either be coupled first to the drawer slide rail or to the cabinet slide rail. In the first case, the drawer and intermediate slide rails are moved together relative to the cabinet slide rail and their relative position remains constant until they are fully extended relative to the cabinet slide rail. This has the advantage that the stationary cabinet slide rail may be provided with receiving ramps or like guides, which assure an automatic retracting, i.e. closing, movement of the drawer. The other embodiment has the advantage that only the drawer slide rail becomes visible at the side of the extended drawer when the same is only slightly extended.

According to a preferred feature, the coupling element is a snap-action locking member comprising a stop engaging the abutment device on the drawer slide rail in both end positions of the coupling element, and the abutment device on the drawer slide rail is arranged to entrain the stop upon moving the slide rails into the predetermined extended position to release the coupling element from the one end position and to restore the coupling element to the one end position upon moving the slide rails into the predetermined retracted position. This will reduce the number of required operating parts and will accordingly reduce the manufacturing costs.

The stop and the abutment device on the drawer slide rail preferably each have two engagement faces, respective pairs of the engagement faces of the stop and the abutment device cooperating during the movements of the slide rails into the extended and retracted positions, one of the engagement faces of the abutment device cooperating with one of the engagement faces of the stop only in the other end position of the coupling element. In this way, the engagement face for the retracting movement remains in the position in which the snap-action locking member is released from engagement with the abutment device until a further retracting movement re-engages the locking movement with the abutment device and fixes the intermediate slide rail in its retracted position.

The two engagement faces of the stop may define a recess therebetween, the two engagement faces being spaced a distance sufficient for receiving the abutment device therebetween. It is also possible, however, to provide an abutment device comprised of two projections cooperating with two faces of a nose protruding from the coupling element. The projections may have different heights, the lower projection cooperating with the coupling element during the retracting movement.

Various structures may be used for the coupling element of the invention. It may be constituted by a dead-center ratchet mechanism having two effective positions or by other positively acting ratchet means which are adapted to be released by engagement of the abutment device with a part connected to the coupling element for pivoting the same between the two end positions. According to a preferred embodiment, which is simple, the coupling element is a spring-biased snap-action locking member pivotal by the abutment device on the drawer slide rail upon movement of the slide rails between the retracted and extended positions.

The coupling element may be a shaped, snap-action locking member comprising a spring biasing the locking member towards the second end position and a stop projecting from the intermediate slide rail and engaging the abutment device on the drawer slide rail in both end positions of the coupling element. The two end positions will be clearly defined if the arrangement further comprises a supporting part defining an indentation receiving the stop by snap-action in the one end position. The same purpose will be served if the spring has a free end and is eyelet-shaped, and the locking member defines two indentations arranged respectively to receive the free spring end by snap-action in the two end positions.

By suitably shaping the locking member and its mounting, the locking member may be incorporated into a body which may be snapped into the intermediate slide rail so that a very simple assembly is possible. A locking member of an elastic synthetic resin material will not be subject to corrosion and will also avoid perceptible noise during the sliding movements, which is of particular importance. It is also possible to provide not only an integrally shaped synthetic resin locking member, but a multi-part locking member, individual parts of which may consist of different materials.

Such a slide arrangement may further comprise a guide cage for the locking member, means on the intermediate slide rail for holding the guide cage by snap-action, and the guide cage comprising the supporting part. This will simplify the manufacture if the shape of the locking member is more complex and it will also facilitate the mounting of the locking member on the slide rail. For this purpose, the guide cage may comprise a pin engaging an elongated slot in the locking member whereby the locking member is firmly but movably held in the guide cage.

Positive locking of the intermediate slide rail in both end positions can be assured when the abutment device on the cabinet slide drawer has a first engagement face for the locking member facing away from a forward end of the intermediate slide rail and a second engagement face facing towards the forward end, the spring being eyelet-shaped and engaging the second engagement face for biasing the locking member into locking engagement with the first engagement face in the one end position, and the spring bias being released upon moving the slide drawers into the second position.

The objects, advantages and features of the present invention will become more apparent from the following description of certain now preferred embodiments thereof, taken in conjunction with the accompanying drawing wherein FIG. 1 is a fragmentary side elevational view of one embodiment of a sequentially operable drawer slide arrangement, showing the drawer slide rail completely extended from the intermediate slide rail which remains coupled to the stationary cabinet slide rail at a front end thereof;

FIG. 2 is a like view, showing the intermediate slide rail released from the cabinet slide rail and partially extended;

FIGS. 5 and 6 are like views showing a further embodiment, FIG. 5 illustrating the arrangement in the retracted position of the slide rails while FIG. 6 illustrates the arrangement with partially extended intermediate and drawer slide rails.

Figure 3:
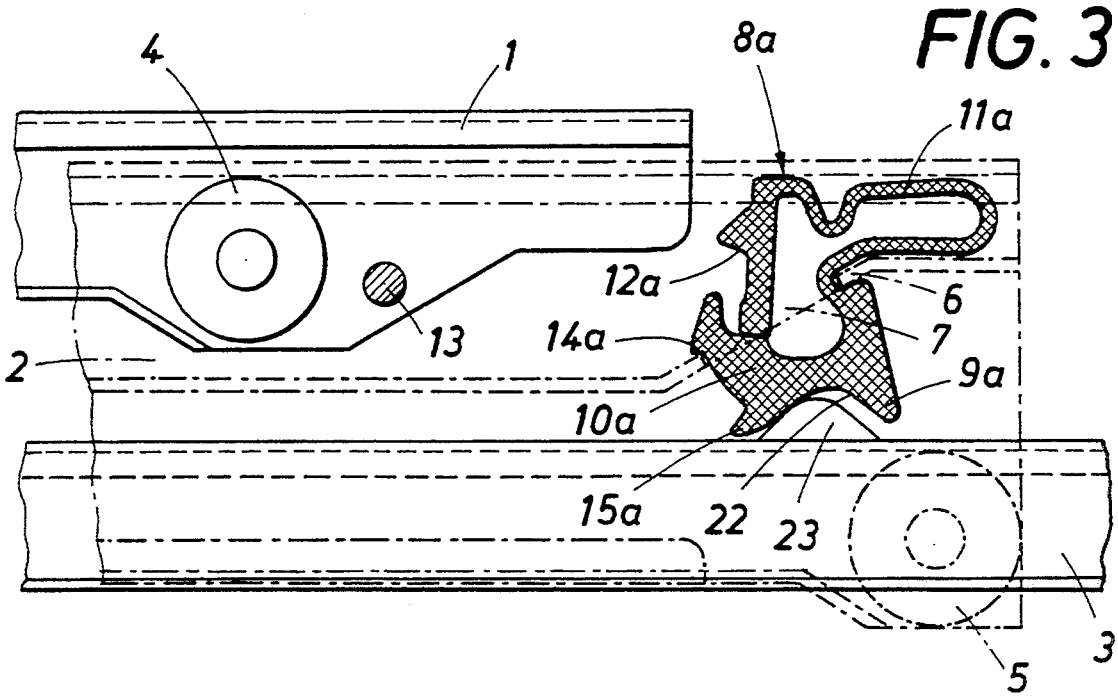
FIG. 3 is a view like that of FIG. 2, showing another embodiment.
Figure 4:
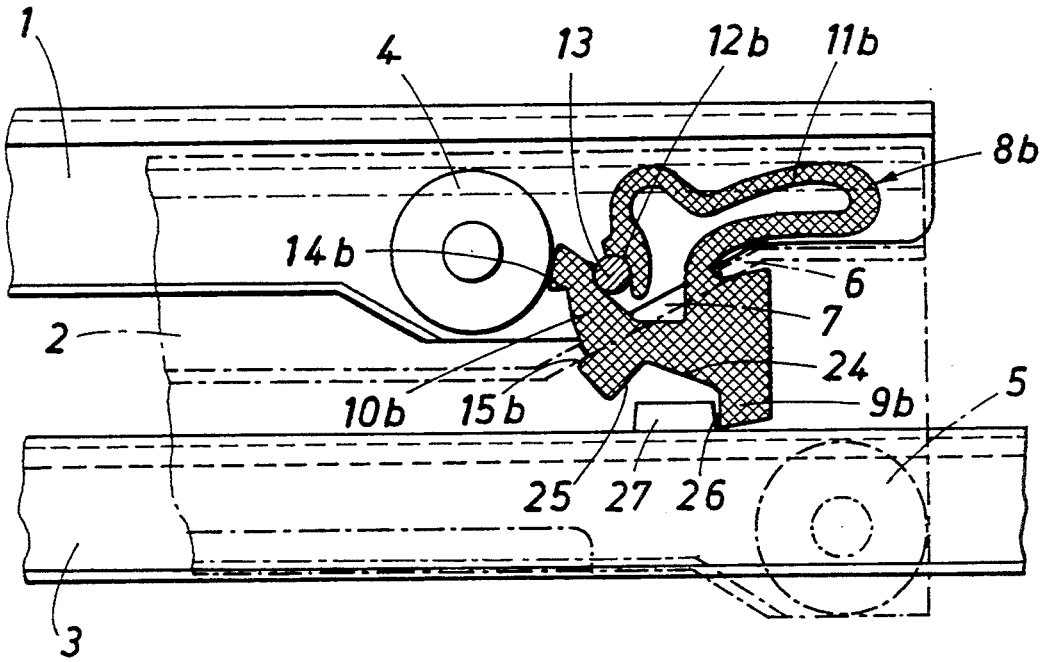
FIG. 4 is a view like that of FIG. 1, showing a third embodiment.

In the drawing, like reference numerals designate like parts functioning in a like manner in all figures, with suffixes a and b, respectively, being used in FIGS. 3 and 4, and suffix c being used in FIGS. 5 and 6. Furthermore, for greater clarity, the intermediate slide rail has been shown in phantom lines and transparent. The coupling element constituting a snap-action locking member has been cross-hatched in FIGS. 1–4, and so has the guide cage in FIGS. 5 and 6.

The illustrated sequentially operable drawer slide arrangement comprises stationary cabinet slide rail 1, intermediate slide rail 2 and drawer slide rail 3. Close to its forward end, cabinet slide rail 1 carries roller 4 which supports intermediate slide rail 2 for sliding movement along a guide constituted by an upper flange. The intermediate slide rail has a roller (not shown) at a rear end thereof, which runs on an associated guide of the cabinet slide rail. It also has a forward roller 5 cooperating with drawer slide rail 3, which is supported by a rear roller (not shown) in intermediate slide rail 2. Since such an arrangement is well known, it requires no detailed explanation.

In the embodiments of FIGS. 1 to 4, a forward end of a laterally projecting flange 6 of intermediate slide rail 2, which is not required for a guide, has an opening 7 for holding coupling element 8, **8*a*, 8*b*. The coupling element is a shaped, pivotal snap-action locking member 10, 10*a*, 10*b* comprising stop 9, 9*a*, 9*b* and eyelet-shaped spring 11, 11*a*, 11*b* extending from the stop remote from the locking member and defining receiving recess 12, 12*a*, 12*b*** at an end of the spring close to the locking member.

Cabinet slide rail 1 carries pin 13, which constitutes an abutment device for locking member 10, **10*a*, 10*b*, as shown in FIGS. 1 and 4, where pin 13 is wedged between the locking member and recess 12, 12*a*, 12*b* and the pin engages and biases spring 11, 11*a*, 11*b***.

Locking member 10, **10*a*, 10*b* has two outer engagement faces 14, 14*a*, 14*b* and 15, 15*a*, 15*b* cooperating with the outside and inside of the associated edge of opening 7. Shaped coupling element 8, 8*a*, 8*b* may be inserted laterally into opening 7, which causes a wedging action to be exerted upon a portion of the coupling element positioned behind stop 9, 9*a*, 9*b*, and spring 11, 11*a*, 11*b* is so shaped that it will engage flange 6 so that stop 9, 9*a*, 9*b* will be slightly spaced from the upper edge of drawer slide rail 3 in every position. As shown in FIGS. 1 and 2, the stop has a nose 16 defining engagement faces at a rear and front of the nose for cooperating with engagement faces on an abutment device which is formed by entrainment elements 17, 18 upwardly projecting from an upper flange of the drawer slide rail. As shown in FIGS. 1 and 2, eyelet-shaped spring 11 has been biased in the sense of reducing its diameter, two recesses 20 and 21 being provided for receiving spring end 19**, which snaps in a respective recess in the two end positions of the pivotal locking member.

In the position of FIG. 1, stop 9 and locking member 10 are held in a position in which locking member 10 by engagement with pin 13 couples intermediate slide rail 2 to stationary cabinet slide rail 1, due to spring end 19 being snapped into recess 20, the wedging action of eyelet-shaped spring 11 and also the wedging at the edges of opening 7. As soon as upwardly projecting abutment 18 engages engagement face 16 upon extending the drawer slide rail, stop 9 is pivoted and moves locking member 10 until engagement face 14 engages the inner edge of opening 7 so that locking member 10 is released from pin 13. As shown in FIG. 2, spring end 19 then snaps into recess 20 so that coupling element 8 assumes the shape shown in FIG. 2, in which the lower end of stop 9 is disposed below the apex of abutment 18 so that nose 16 which faces this abutment constitutes a counterstop therefor when drawer slide rail 3 is retracted.

When drawer slide rail 3 is retracted, for example from the position shown in FIG. 2, upwardly projecting abutment 18 applies pressure to nose 16 so that intermediate slide rail 2 is positively locked to the drawer slide rail and entrained therewith. As soon as recess 12 engages pin 13, spring end 19 is pivoted and is moved out of recess 20. The spring bias causes locking member 10 to snap into engagement with pin 13, as shown in FIG. 1, and intermediate slide rail 2 is coupled to cabinet slide rail 1 again. This causes the lower end of nose 16 to be disposed above abutment 18, and nose 16 cannot interfere with the further retracting movement of drawer slide rail 3 from the position shown in FIG. 1. Coupling element 8 remains in this position until a further sliding movement as hereinabove described.

The embodiments of FIGS. 3 and 4 function in substantially the same manner as the construction illustrated in FIGS. 1 and 2. One difference resides in the shape of the eyelet-shaped spring.

In the embodiment of FIG. 3, spring 11*a* is also biased in the sense of contraction. Stop 9*a* defines a concavely curved recess 22 whose edges constitute engagement faces for the two sides of a single upwardly projecting abutment 23. After locking member 10*a* has been disengaged from pin 13, it is pivoted so that the left edge of recess 22 no longer interferes with the retraction of abutment 23 and drawer slide rail 3 while the right edge remains in engagement with abutment 23 so that coupling element 8*a* may be entrained by the abutment into the release position shown in FIG. 3.

In the embodiment of FIG. 4, stop 9*b* defines a recess 24 which is defined between two rectilinear engagement faces 25, 26 for engagement by abutment projection 27. When drawer slide rail 3 is moved out of the illustrated position to the right, upwardly projecting abutment 27 will pivot stop 9*b* and locking member 10*b* until engagement face 14*b* engages the edge of opening 7 of flange 6, which causes pin 13 to be released and engagement face 25 to be pivoted into a position in which it can be engaged with the left engagement face of abutment 27 during the retracting movement of drawer slide rail 3. In the position shown in FIG. 4, abutment 27 can move freely under engagement face 25.

In all embodiments, the abutment device on the cabinet slide rail may be constituted not only by illustrated pin 13 but may be formed by a lug which may be stamped out of the cabinet slide rail or otherwise formed thereon. In the embodiment of FIGS. 5 and 6, it is a part 13*a* which is rectangular in cross section.

The embodiment of FIGS. 5 and 6 differs from the embodiments described hereinabove primarily in that a foot portion 30 of a guide cage 29 is snapped into a holder 28 affixed to intermediate slide rail 2 or shaped from this rail. Guiding and supporting parts 31, 32 are attached to the holder. Guide cage 29 defines a receiving recess 33 for eyelet-shaped spring 34 of shaped coupling element 8*c* provided with pivotal locking member 10*c*. The coupling element is retained in guide cage 29 by cross pin 35 extending into elongated slot 36. Upwardly projecting abutment 37 is again engageable by engagement faces 38, 39 of coupling element 8*c*. Engagement face 38 is provided on a nose which rests in a groove in holder part 32 in the rest position illustrated in FIG. 5.

In the position shown in FIG. 5, locking member 10*c* engages abutment 13*a* to couple intermediate slide rail 2 to cabinet slide rail 1. When abutment 37 engages engagement face 39 upon extension of the drawer slide rail, engagement face 38 is disengaged from the groove in holder part 32 and coupling element 8*c* is pivoted into the position shown in FIG. 6. In this position, locking member 10*c* is disengaged from abutment 13*a* so that intermediate slide rail 2 may be extended from stationary cabinet slide rail 1. At the same time, an engagement cam 40 on drawer slide rail 3 engages roller 5 and thus prevents a further extension of rail 3. Upon retraction, abutment 37 pivots coupling element 8*c* back into the position wherein locking member 10*c* engages abutment 13*a*.

Another embodiment is also possible, in which drawer slide rail 3 is suitably coupled to intermediate slide rail 2 by coupling means which are disengaged only when the drawer and intermediate slide rails are fully extended from the stationary cabinet slide rail so that drawer slide rail 2 may be farther extended from the extended intermediate slide rail. To obtain a proper sequencing during the retracting movement, an additional positive locking coupling may be provided, which fixes the position of the fully extended intermediate slide rail relative to the cabinet slide rail and releases this coupling only when the drawer slide rail is fully retracted into the intermediate slide rail.

I claim:

1. A sequentially operable drawer slide arrangement comprising (a) a stationary cabinet slide rail, (b) an intermediate slide rail guided on the cabinet slide rail by a roller mounted on the cabinet slide rail for sliding movement with respect to the cabinet slide rail between a retracted and an extended position, (c) a drawer slide rail guided on the intermediate slide rail by a roller mounted on the intermediate slide rail for sliding movement with respect to the intermediate slide rail between a retracted and an extended position, and (c) means for sequencing the sliding movements of the intermediate and drawer slide rails between said positions, the sequencing means comprising (1) a coupling element arranged on the intermediate slide rail close to a forward end thereof for pivoting between two end positions to lock the intermediate slide rail selectively to the cabinet slide rail or the drawer slide rail in the respective end positions, and (2) abutment devices respectively arranged on the cabinet and drawer slide rails to cooperate with the coupling element, the abutment device on the cabinet slide rail cooperating with the coupling element in one end position to lock the intermediate slide rail positively to the cabinet slide rail in a predetermined retracted position while, upon moving the slide rails into a predetermined extended position, the abutment device on the drawer slide rail simultaneously releases the coupling element from the one end position and pivots it into the other end position wherein it cooperates with the abutment device on the drawer slide rail to lock the intermediate slide rail to the drawer slide rail, the coupling element being restored to the one end position positively locking the intermediate slide rail to the cabinet slide rail upon moving the slide rails into the predetermined retracted position.

2. The sequentially operable drawer slide arrangement of claim 1, wherein the coupling element is a snap-action locking member comprising a stop engaging the abutment device on the drawer slide rail in both end positions of the coupling element, and the abutment device on the drawer slide rail being arranged to entrain the stop upon moving the slide rails into the predetermined extended position to release the coupling element from the one end position and to restore the coupling element to the one end position upon moving the slide rails into the predetermined retracted position.

3. The sequentially operable drawer slide arrangement of claim 2, wherein the stop and the abutment device on the drawer slide rail each have two engagement faces, respective pairs of the engagement faces of the stop and abutment device cooperating during the movements of the slide rails into the extended and retracted positions, one of the engagement faces of the abutment device cooperating with one of the engagement faces of the stop only in the other end position of the coupling element.

4. The sequentially operable drawer slide arrangement of claim 3, wherein the two engagement faces of the stop define a recess therebetween, the two engagement faces being spaced a distance sufficient for receiving the abutment device therebetween.

5. The sequentially operable drawer slide arrangement of claim 1, wherein the coupling element is a spring-biased snap-action locking member pivotal by the abutment device on the drawer slide rail upon movement of the slide rails between the retracted and extended positions.

6. The sequentially operable drawer slide arrangement of claim 1, wherein the coupling element is a shaped, snap-action locking member comprising a spring biasing the locking member towards the second end position and a stop projecting from the intermediate slide rail and engaging the abutment device on the drawer slide rail in both end positions of the coupling element.

7. The sequentially operable drawer slide arrangement of claim 6, further comprising a supporting part defining an indentation receiving the stop by snap-action in the one end position.

8. The sequentially operable drawer slide arrangement of claim 7, further comprising a guide cage for the locking member, means on the intermediate slide rail for holding the guide cage by snap-action, and the guide cage comprising the supporting part.

9. The sequentially operable drawer slide arrangement of claim 8, wherein the guide cage comprises a pin engaging an elongated slot in the locking member whereby the locking member is firmly but movably held in the guide cage.

10. The sequentially operable drawer slide arrangement of claim 6, wherein the abutment device on the cabinet slide drawer has a first engagement face for the locking member facing away from a forward end of the intermediate slide rail and a second engagement face facing towards the forward end, the spring being eyelet-shaped and engaging the second engagement face for biasing the locking member into locking engagement with the first engagement face in the one end position, and the spring bias being released upon moving the slide drawers into the second position.

11. The sequentially operable slide drawer arrangement of claim 6, wherein the spring has a free end and is eyelet-shaped, and the locking member defines two indentations arranged respectively to receive the free spring end by snap-action in the two end positions.

* * * * *